US007303066B2

(12) United States Patent
Rumer

(10) Patent No.: US 7,303,066 B2
(45) Date of Patent: Dec. 4, 2007

(54) STEERING GUIDE

(75) Inventor: David O. Rumer, Chicago, IL (US)

(73) Assignee: AccuWeb, Inc., Madison, WI (US)

( * ) Notice: Subject to any disclaimer, the term of this patent is extended or adjusted under 35 U.S.C. 154(b) by 164 days.

(21) Appl. No.: 11/047,862

(22) Filed: Jan. 31, 2005

(65) Prior Publication Data

US 2005/0189389 A1 Sep. 1, 2005

Related U.S. Application Data

(60) Provisional application No. 60/548,234, filed on Feb. 27, 2004.

(51) Int. Cl.
*B65G 21/16* (2006.01)

(52) U.S. Cl. ..... 198/831; 226/180

(58) Field of Classification Search ..... 198/810.03, 198/806, 831, 817; 226/180, 190, 191, 192, 226/21, 24, 28

See application file for complete search history.

(56) References Cited

U.S. PATENT DOCUMENTS

| | | | | |
|---|---|---|---|---|
| 3,326,435 | A | 6/1967 | Shelton | |
| 3,602,191 | A | 8/1971 | Gorton et al. | |
| 3,724,732 | A | 4/1973 | Bonner | |
| 4,069,959 | A | 1/1978 | Bartell et al. | |
| 4,204,619 | A | 5/1980 | Damour | |
| 4,216,845 | A * | 8/1980 | Tashman et al. | 198/831 |
| 4,342,412 | A | 8/1982 | Lorenz et al. | |
| 4,477,006 | A | 10/1984 | Sharp | |
| 5,074,450 | A * | 12/1991 | Lindner et al. | 226/21 |
| 5,427,295 | A * | 6/1995 | David | 226/180 |
| 6,386,355 | B1 * | 5/2002 | Willems | 198/831 |
| 6,474,528 | B2 | 11/2002 | Scharschinger et al. | |
| 6,554,540 | B1 * | 4/2003 | Corsan | 226/180 |
| 2003/0192769 | A1 * | 10/2003 | Cotter et al. | 198/831 |

FOREIGN PATENT DOCUMENTS

| | | |
|---|---|---|
| DE | 30 08 775 A1 | 9/1981 |
| DE | 31 25853 C1 | 1/1983 |
| DE | 3212176 | 10/1983 |

* cited by examiner

*Primary Examiner*—James R. Bidwell
(74) *Attorney, Agent, or Firm*—Brinks Hofer Gilson & Lione

(57) ABSTRACT

A steering guide laterally positions material running over rollers rotating in a roller carriage. The steering guide imparts angular displacement to a support platform positioned between a grooved inner track and a grooved outer track. The roller carriage, which may vary substantially is size and shape, is coupled with the support platform. The steering guide eliminates the need for a separate rack that supports the weight of the roller carriage. The steering guide thereby reduces complexity, cost, and spare part inventories, while simplifying assembly, installation, and maintenance. The steering guide also precisely locates the roller carriage with respect to a virtual center, thereby enhancing accurate steering of the web. In addition, the steering platform may be formed from strong but light aluminum, thereby reducing inertial forces that act when the steering guide moves the support platform.

38 Claims, 7 Drawing Sheets

STEERING GUIDE

CROSS REFERENCE TO RELATED APPLICATIONS

This application claims the benefit of U.S. Provisional Pat. App. Ser. No. 60/548,234, filed Feb. 27, 2004.

BACKGROUND

1. Technical Field

This invention relates to a steering mechanism. In particular, the present invention relates to a steering guide that laterally positions a web traveling over a roller carriage.

2. Background Information

Modern manufacturing processes employ traveling webs of many different materials such as paper and plastic film. Efficient high volume production requires that the web arrive at subsequent process stages in a consistent and predictable manner. Accordingly, great care must be taken to ensure that the web maintains accurate positioning as it travels through different stages of the manufacturing process.

In the past, guide mechanisms suffered from several shortcomings. For example, some prior guide mechanisms required separate racks to support the roller frame over which the web traveled. Additional components such as separate racks increased complexity, cost, and spare part inventories, while complicating assembly, installation, and maintenance of the guide mechanism.

A need has long existed to address the problems noted above and others previously experienced.

DETAILED DESCRIPTION OF THE PRESENTLY PREFERRED EMBODIMENTS

Figure 1:
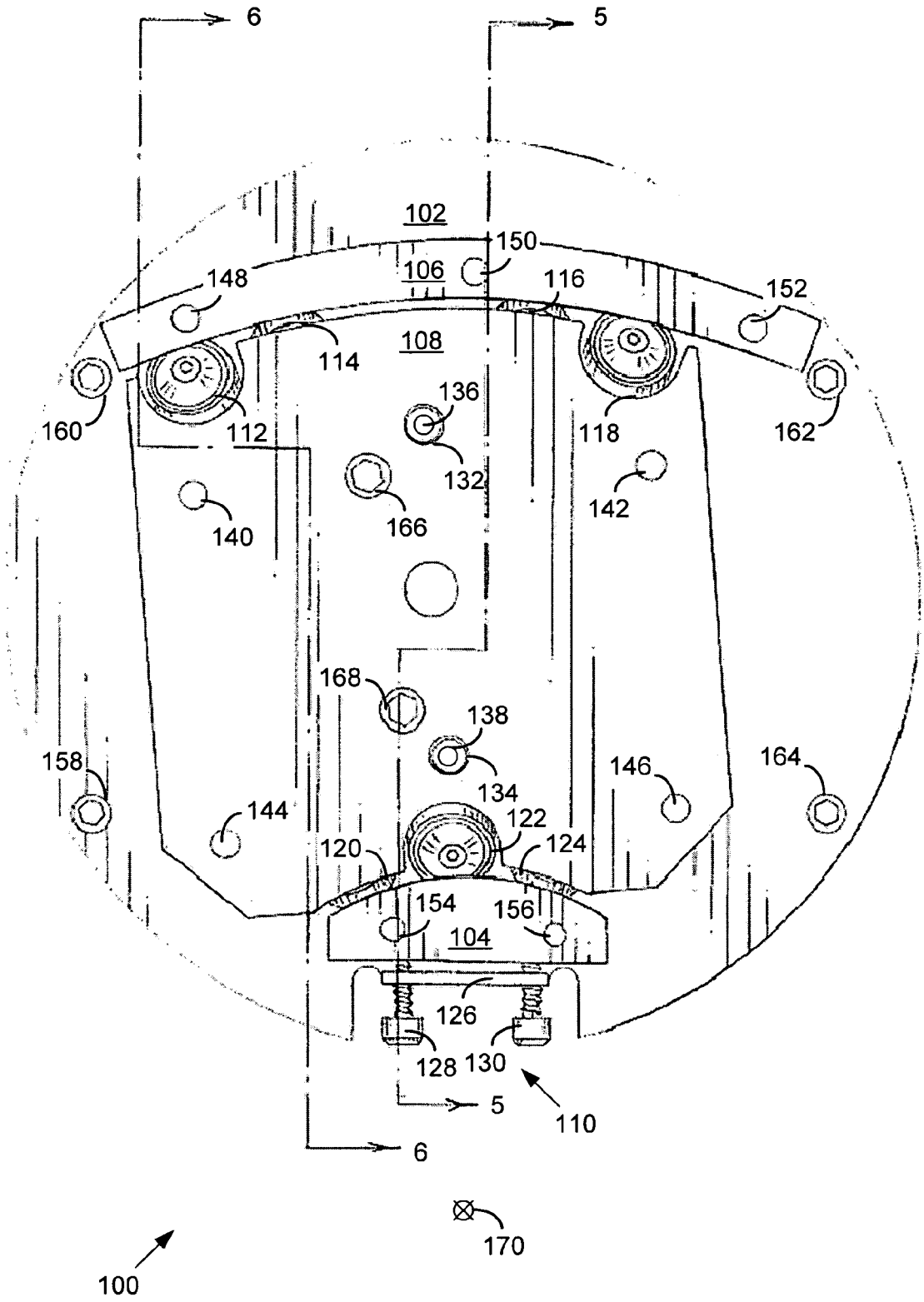
FIG. 1 illustrates top view of the steering guide.

All of the discussion below, regardless of the particular implementation being described, is exemplary in nature, rather than limiting. For example, although selected aspects, features, or components of the implementations are described as being manufactured from certain materials, or as having certain tolerances, sizes, lengths, or other measures, or as being secured together with certain fasteners, all or part of a steering guide consistent with the present invention may be manufactured from other materials with other tolerances and sizes, and may be secured together with different fasteners.

By way of introduction, a steering guide includes a support platform that moves between two tracks. The steering guide may couple to a material guide frame. For example, the material guide frame may be coupled to the support platform and move with the support platform.

A steering guide consistent with this invention may include a curved inner track, a curved outer track, and a support platform disposed between the tracks. The tracks guide the movement of the support platform. In addition, the steering guide may include an actuator coupling coupled to the support platform. The actuator coupling may impart an angular displacement to the support platform. Furthermore, a material guide frame may be coupled to the support platform. When the support platform moves, the material guide may then move to steer a web.

In one implementation, the curved inner and outer tracks each include a guide groove facing the support platform. The guide grooves may include an upper groove track and a lower groove track. One or more rotational couplings may be disposed between the guide grooves and the support platform. In one implementation, the rotational couplings are wheels. The wheels may be oriented in opposition to one another and may roll along either the upper groove track or the lower groove track of the guide grooves.

In addition, a track adjustment may be provided for the steering guide. The track adjustment may position the inner track with respect to the support platform and outer track, for example. Accordingly, the inner track position may be adjusted to provide, as examples, desired tension, fit, placement, or support for the support platform.

The steering guide eliminates the need for a separate rack that supports the weight of the material guide frame. The steering guide thereby reduces complexity, cost, and spare part inventories, while simplifying assembly, installation, and maintenance. The steering guide also precisely locates the material guide frame with respect to a virtual center, thereby enhancing accurate steering of the web.

In addition, the support platform may be formed from strong but light aluminum, thereby reducing inertial forces that act when the steering guide moves the support platform. The materials used for the steering guide components may be selected, for example, from several grades of aluminum that although are strong and hard are also machinable. The steering guide may support material guide frames that vary widely in size, shape, and weight, making the steering guide suitable for a wide range of processes for a wide range of materials.

The rotational couplings disposed between the support platform and the inner and outer tracks may be arranged to secure the support platform in place between the inner and outer tracks. Consequently, the support platform provides a stable base or support for a material guide frame. For example, the rotational couplings may precisely locate the support platform to reduce or eliminate lifting, turning, or twisting of the material guide frame that would detrimentally impact efforts to steer the web.

FIG. 1 shows a top view of a steering guide 100. The steering guide 100 includes a guide base 102, a curved inner track 104, and a curved outer track 106 coupled with the guide base 102. As used herein, "coupled with" may indicate a direct connection or an indirect connection through one or more intervening components or structures. A support platform 108 is in position between the inner track 104 and the outer track 106. An inner track adjustment 110 is also present.

As shown in FIG. 1, rotational couplings 112, 114, 116, and 118 are in place between the outer track 106 and the support platform 108. Similarly, rotational couplings 120, 122, and 124 are in place between the inner track 104 and the support platform 108. Along the outer track 106, the rotational couplings 112 and 114, and 116 and 118 are arranged adjacent to one another in pairs.

Other positions and arrangements of the rotational couplings also may be employed, however. For example, additional or fewer rotational couplings may be included between the tracks 104 and 106 and the support platform 108. The rotational couplings need not be grouped in pairs, but may take any spacing or orientation along the tracks 104 and 106. Accordingly, although the rotational couplings 112-124 may be oriented at 45 degrees with respect to the support platform 108, the rotational couplings also may be disposed at other angles.

The inner track adjustment 110 includes a spacer 126 and adjustment screws 128 and 130. The support platform 108 may include positive location holes 132 and 134 that accept positioning posts on a steering frame to be secured to the support platform 108. The threaded connector holes 136 and 138 are aligned with the positive location holes 132 and 134. The connector holes 132-138 may be employed to secure a material guide frame such as a roller carriage to the support platform 108. To that end, the support platform 108 also may include additional threaded guide frame connector holes 140, 142, 144, and 146.

The outer track 106 may include threaded connector holes 148, 150 and 152, while the inner track 104 may include threaded connector holes 154 and 156. The guide base 102 may include the threaded mounting holes 158, 160, 162, and 164. As will be described in more detail below, the bolts 166 and 168 in the support platform 108 secure actuator couplings to the support platform 108.

The examples above refer to threaded holes that accept, for example, bolts. However, other fasteners may be employed. As examples, pins, rivets, lock washers, bolts, welds, threaded rods, screws, or other mechanisms for securing components may be incorporated into the steering guide 100.

The support platform 108 rotates with respect to the virtual center 170. As will be explained in more detail below, the virtual center 170 may be located at the point where the material web runs up over an entry roller in a roller carriage secured to the support platform 108. By moving the support platform 108, the material web may be steered over an exit roller in the roller carriage.

The inner track 104, outer track 106, and support platform 108 may be manufactured from aluminum. The guide base 102 may be formed from mill run steel. In one implementation, the inner track 104 and outer track 106 may be manufactured from a material with excellent strength, hardness, and machinability, such as 6000 or 7000 series aluminum, while the support platform 108 may be manufactured from 2000 series aluminum. The mass of the support platform 108 is therefore kept small, which also reduces inertial forces that act when the steering guide moves the support platform 108 to steer the web. Other materials with similar properties may be employed in the construction of the steering guide, however. The materials may include molded elastomers, polymer alloys, liquid molding compounds, or other materials. The aluminum optionally may be anodized.

The inner track 104 and outer track 106 may each include a guide groove for rotational couplings that faces the support platform 108. Each guide groove may include an upper groove track and a lower groove track. The upper groove track and lower groove track together may form a V-shaped guide groove that accepts opposed rotational couplings oriented at 45 degrees with respect to the support platform 108. The rotational couplings 112-124 may then roll along either the upper groove track or the lower groove track of the inner track 104 and outer track 106.

The rotational couplings 112-124 may include wheels oriented in opposition to one another. For example, the wheel 112 and the wheel 114 may be oriented at 45 degrees and in opposition to one another so that the wheel 112 runs along the lower guide groove while the wheel 114 runs along the upper guide groove in the outer track 106. When individual rotational couplings 112-124 are oriented in opposition (e.g., at 45 degrees to one another), the rotational couplings 112-124 very securely hold the support platform 108 in place. Accordingly, the roller carriage secured to the support platform 108 does not experience lifting, turning, or twisting that would detrimentally impact efforts to steer the material web.

The steering guide 100 need not employ rotational couplings that are oriented in opposition to one another, however. Accordingly, each rotational coupling may, if desired, have the same orientation as any other rotational coupling. Nor need the steering guide 100 employ rotational couplings that are oriented at 45 degrees with respect to the support platform. Rather, the rotational couplings may be oriented at other angles.

A computer numerically controlled machining process (e.g., a CNC mill) may be employed to machine the inner track 104, outer track 106, and support platform 108. The outer track 106 locates the roller carriage to the virtual center 170. Accordingly, during machining, the tolerance on the outer track 106 may be carefully controlled so that the thickness of the outer track 106 does not vary by more than 3-5 thousandths of an inch. The tolerance on the inner track 104 may be more relaxed, however.

The inner track adjustment 110 may provide approximately 3-4 thousandths of adjustment in the position of the inner track 104. The standoff 126 of the inner track adjustment 110 may be formed from a flanged portion of the guide base 102 to eliminate the need for a separate spacer structure and associated securing mechanism. The adjustment screws 128 and 130 may be independently adjusted to position the inner track 104. More or less adjustment range may be provided for the inner track adjustment 110 by creating larger or smaller bolt holes for the bolts that screw into the inner track 104.

Figure 2:
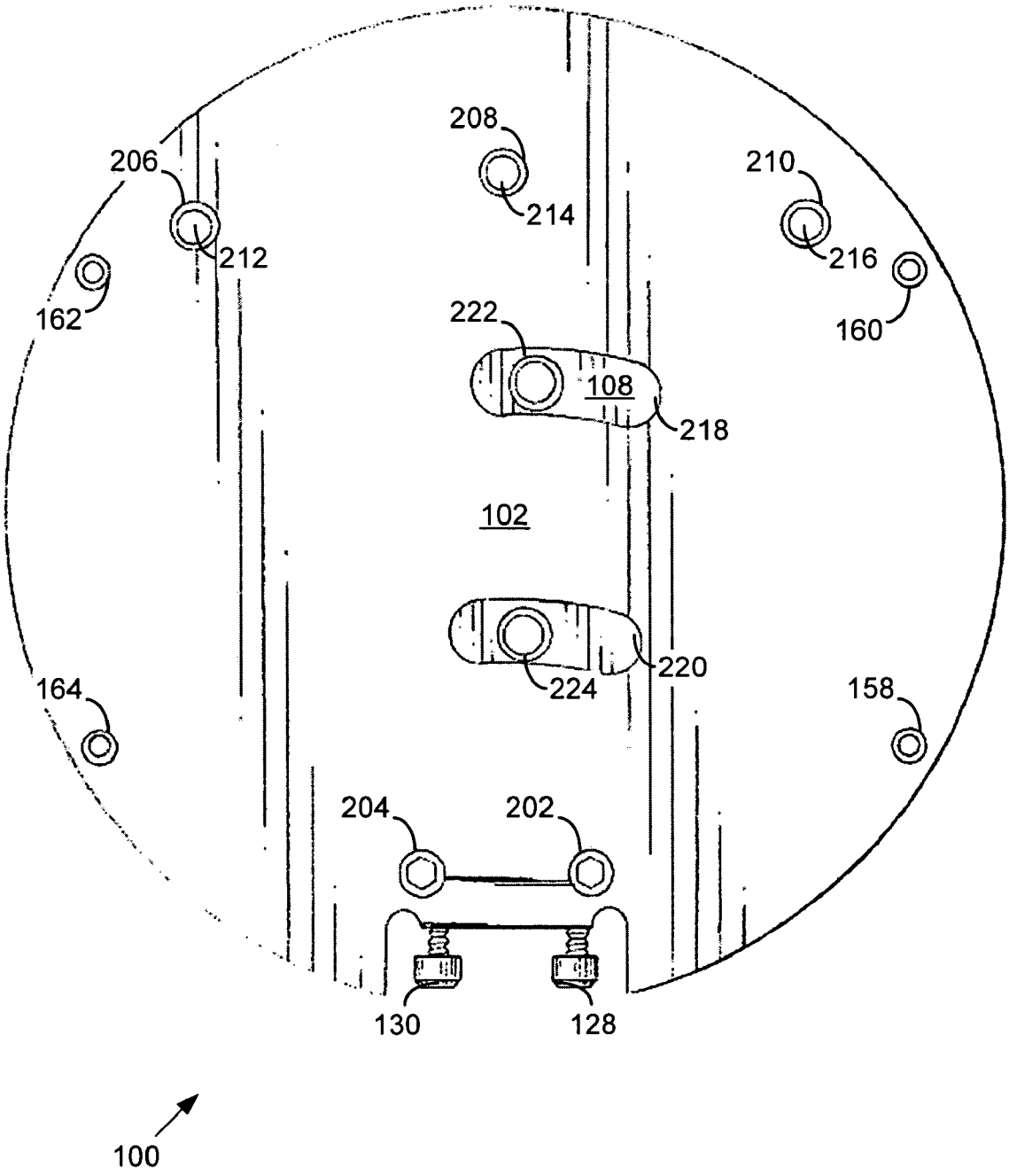
FIG. 2 shows a bottom view of the steering guide.

FIG. 2 illustrates a bottom view of the steering guide 100. FIG. 2 shows inner track bolts 202 and 204, outer track sleeves 206, 208, and 210, and threaded outer track bolt holes 212, 214, and 216. In addition, FIG. 2 shows arcuate slots 218 and 220 defined by the guide base 102. The actuator couplings 222 and 224 extend through the slots 218 and 220 and are connected to the support platform 108.

The inner track bolts 202 and 204 screw into the threaded connector holes 154 and 156 to secure the inner track 104 to the guide base 102. The slots 218 and 220 may vary widely in extent depending on the degree of movement desired for the support platform 108. In one implementation, the slots 218 and 220 allow for up to 5 degrees or up to 10 degrees of rotation in the support platform 108. Expressed another way, the slots 218 and 220 may allow the support platform 108 to move approximately 0.5-1.0 inch in either direction from center position. The extent of movement of the support platform 108 may vary widely, however, to meet any parameters appropriate for the environment in which the steering guide 100 will be employed. Thus, as examples, the support platform may instead rotate up to 15 degrees, up to 30 degrees, or up to another angle.

The actuator couplings 222 and 224 may be steel stems or pegs that extend through the slots 218 and 220. One internally threaded end of the actuator coupling fits into a positioning hole in the support platform 108. The bolts 166 and 168 may then secure the actuator couplings 222 and 224 to the support platform 108. The other end of the actuator coupling may then receive a screw or other drive mechanism. An electric motor or other driving device may then impart angular displacement to the support platform 108 through action on either or both actuator couplings 222 and 224.

Because the actuator couplings differ in their distance from the virtual center 170, they provide different amounts of rotation in the support platform 108 for a given amount of displacement. In addition, the choice of actuator couplings provides flexibility in locating and attaching the drive mechanism. In other implementations, a single actuator coupling may be provided, or more than two actuator couplings may be provided. Furthermore, the actuator couplings may take other forms. As examples, the actuator couplings may be hydraulic, pneumatic, or electrically controlled pistons, stems, rods, or any other couplings to the support platform.

The outer track 106 may include the location sleeves 206, 208, and 210. The sleeves 206-210 extend down from the outer track 106 into the positioning holes for the outer track 106 in the guide base 102. Because the sleeves 206-210 and the positioning holes may be precisely formed and located, the outer track 106 may be precisely located on the guide base 102. The virtual center 170 is thereby precisely located with respect to the outer track 106.

Each sleeve 206-210 may be internally threaded. Accordingly, bolts other fasteners may secure the outer track 106 to the guide base 102 without loss of location precision. The outer track bolts may screw into the threaded connector holes 148, 150, and 152 through the sleeves 206-210.

Figure 3:
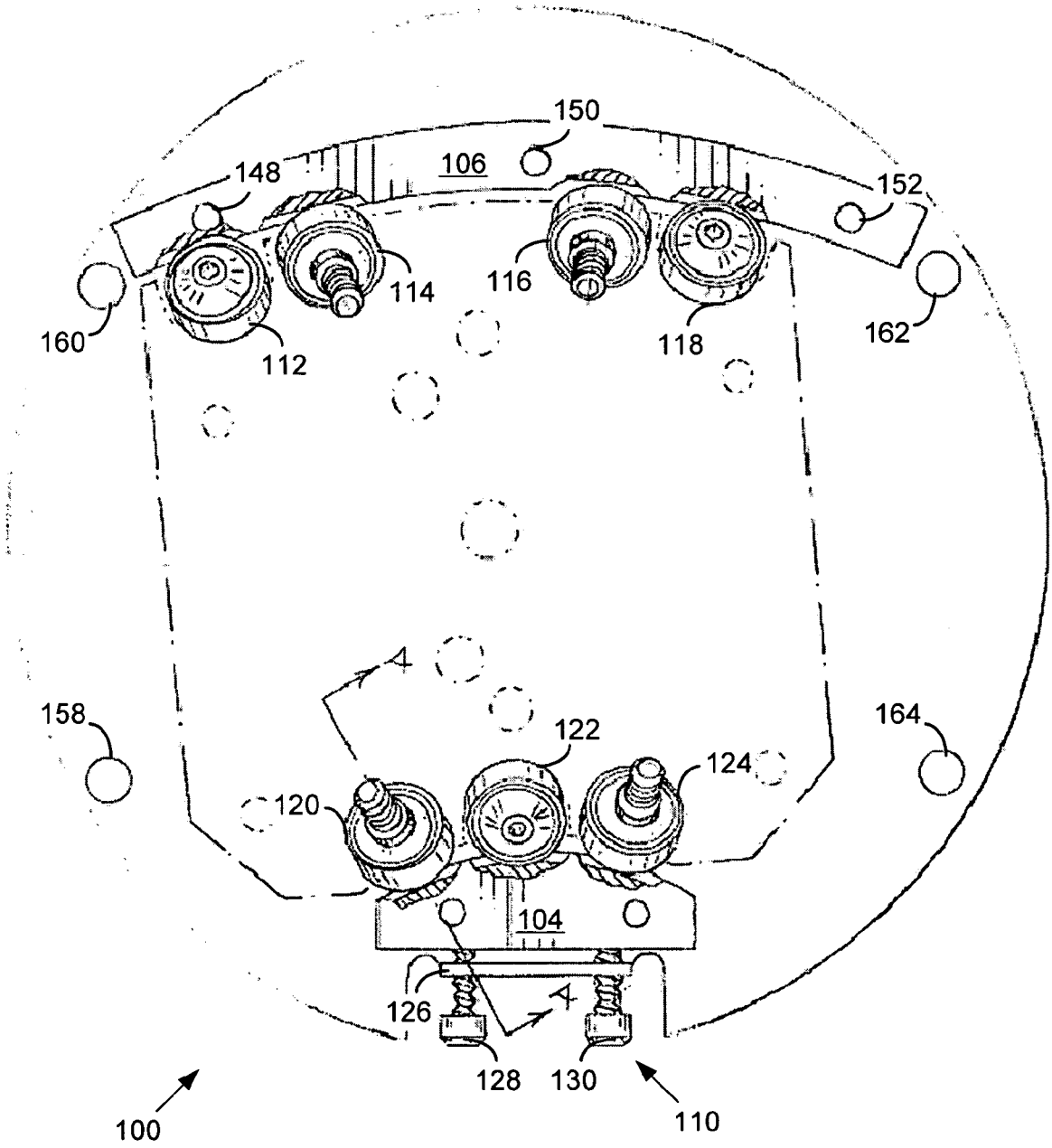
FIG. 3 shows a top view of the steering guide revealing rotational couplings.

FIG. 3 illustrates a top view of the steering guide 100 with the rotational couplings 112-124 revealed. The rotational couplings 112, 114, 116, and 118 move in the guide groove in the outer track 106. The rotational couplings 112 and 114 form one pair of oppositely oriented rotational couplings, while the rotational couplings 116 and 118 form a second pair of oppositely oriented rotational couplings.

Similarly, the rotational couplings 120, 122, and 124 move in the guide groove in the inner track 104. Selected rotational couplings 120, 122, and 124 may be oriented in opposition to other rotational couplings. As shown in FIG. 3, for example, the rotational couplings 120-124 are oriented at a 45 degree angle to the support plate 108. The rotational coupling 122 is oriented in opposition to the rotational couplings 120 and 124. The rotational couplings 120-124 may be secured to the support platform 108 as shown in more detail below with regard to FIG. 4.

Figure 4:
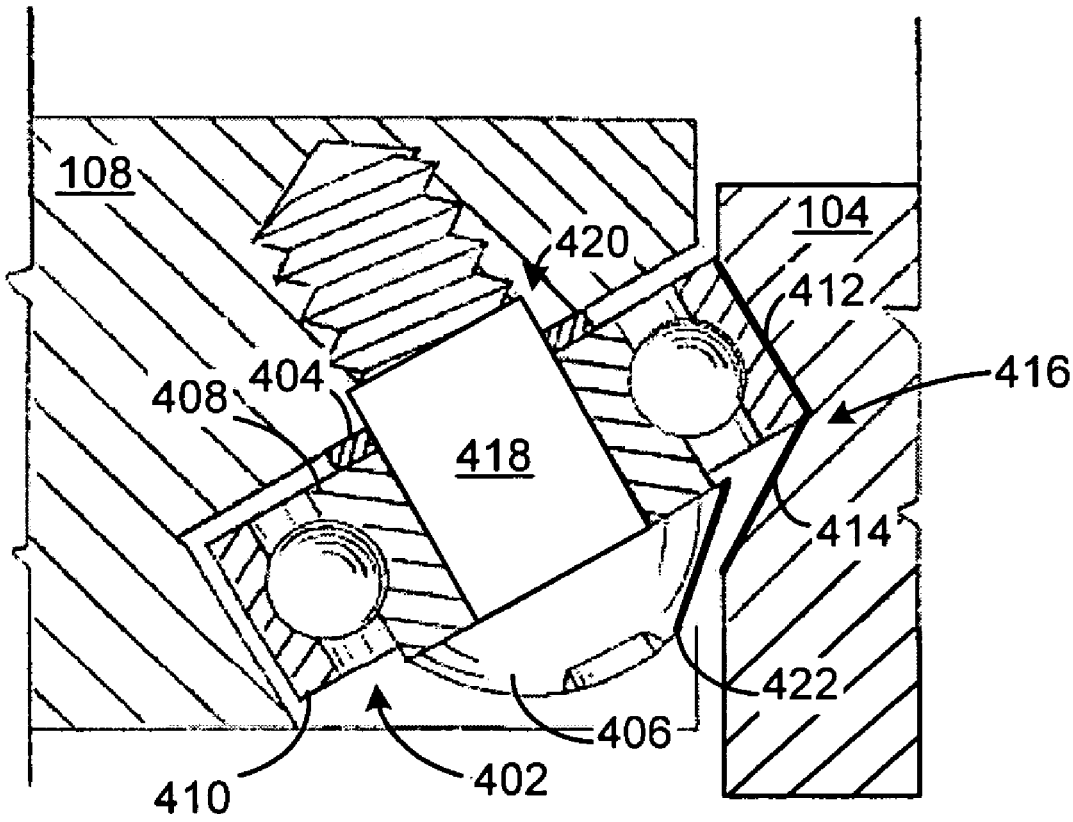
FIG. 4 shows a cross section of a rotational coupling.
Figure 4:
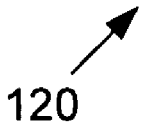

FIG. 4 illustrates a cross section of the rotational coupling 120 along the section line 4-4 indicated in FIG. 3. In one implementation, the rotational coupling 120 includes a ball bearing 402, a shim 404, and a bolt 406. The ball bearing 402 includes an inner ring 408 and an outer ring 410 and is oriented at a 45 degree angle with respect to the support plate 108.

Note that the ball bearing 402 need not be used as a ball bearing in the traditional sense. Rather, the ball bearing 402 may be used as a wheel that rolls along either the upper groove track 412 or lower groove track 414 that form the guide groove 416 in the inner track 104. As will be explained in more detail below, for example, the inner ring 408 may be held in place, while the outer ring 410 rotates or rolls along the groove tracks. In this case, the rotational coupling 120 rolls along the upper groove track 412 of the inner track 104. Together, the upper groove track 412 and lower groove track 414 form the V-shaped guide groove 416 in the inner track 104. A similar guide groove is formed in the outer track 106.

The bolt 406 may be a shoulder bolt that holds the ball bearing 402 in place in the support platform 108. The shoulder portion 418 of the bolt, which has a precise diameter, may extend into a locating hole 420 in the support platform 108 to precisely locate the ball bearing. In addition, the head of the bolt 406 may be machined to form a taper 422 to provide clearance for the bolt head with respect to the outer track 104.

The shim 404 creates a stand off (for example, an approximately 0.010 of an inch standoff) for the inner ring of the ball bearing 402 against the support platform 108. A greater or lesser amount of standoff may be employed. The outer ring 410 of the ball bearing 402 remains free to rotate and roll along the upper groove track 412. The inner ring 408 of the ball bearing 402 may remain fixed against the support platform 108. Suitable ball bearings are commercially available and may be obtained from Browning and other manufacturers.

In one implementation, the ball bearing may be ⅞ inch in diameter, and 0.218 inches wide. However, the steering guide 100 and its constituent components including the ball bearings or other rotational couplings may vary widely in size depending on the desired application. Furthermore the ball bearings may be selected according to a specific hardness, weight, or stress tolerance, or according to other criteria. For example, ball bearings that can support 600 pounds of force may be employed in the design of a steering guide 100 that may support a wide range of material guide frames.

Figure 5:
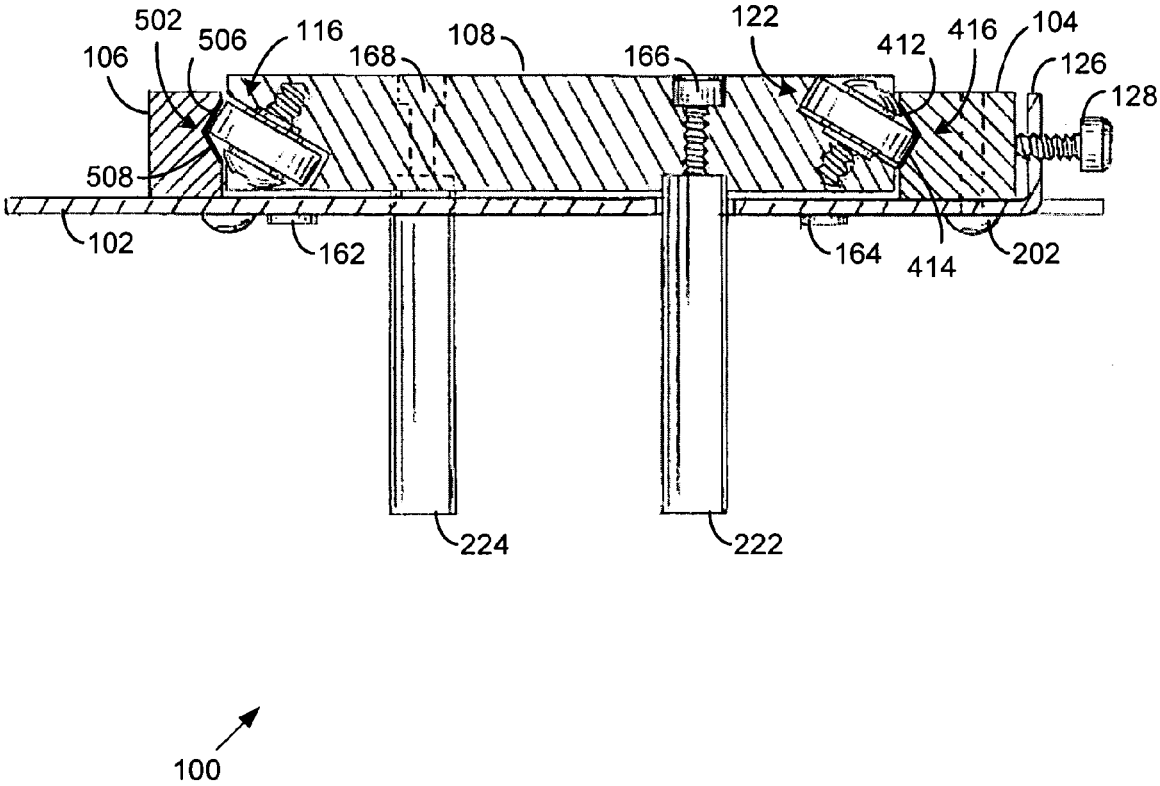
FIG. 5 shows a sectional view of the steering guide.

FIG. 5 shows a sectional side view of the steering guide 100 along the section line 5-5 shown in FIG. 1. FIG. 5 shows the guide groove 502 in the outer track 106 and the guide groove 416 in the inner track 104. The guide grooves 502 and 416 may be V-shaped grooves that accommodate opposed 45 degree oriented rotational couplings. The guide groove 502 includes an upper groove track 506 and a lower groove track 508. The guide groove 416 includes the upper groove track 412 and the lower groove track 414.

The rotational coupling 116 is secured into the support plate 108 at a 45 degree angle such that the rotational coupling 116 rolls along the upper groove track 506. The rotational coupling 122 also is secured into the support plate 108 at a 45 degree angle. The rotational coupling 122 is in opposition to the rotational coupling 116, and rolls along the lower groove track 414.

Figure 6:
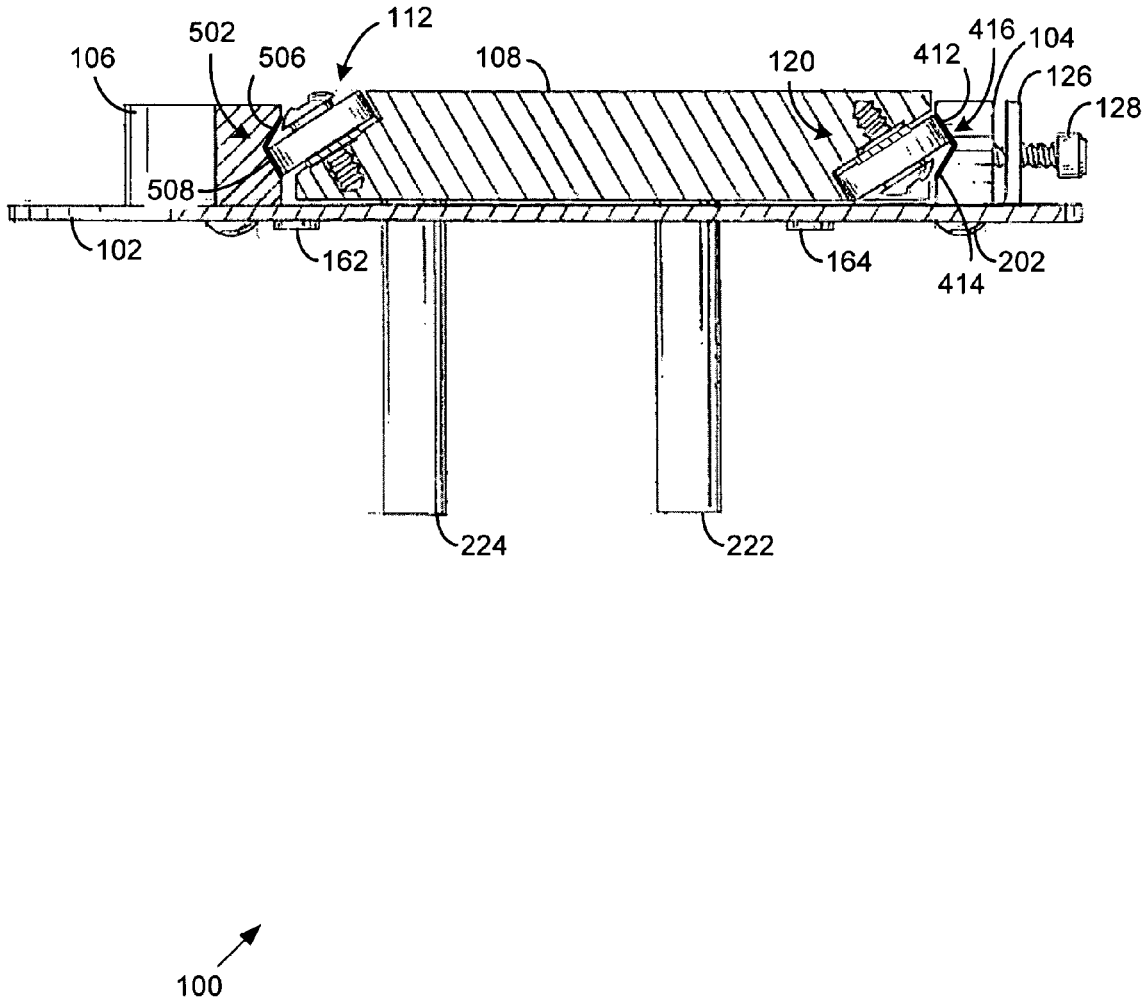
FIG. 6 illustrates a sectional view of the steering guide.

FIG. 6 shows a sectional side view of the steering guide 100 along the section line 6-6 shown in FIG. 1. FIG. 6 also shows the guide groove 502 in the outer track 106 and the guide groove 504 in the inner track 104. In FIG. 6, the rotational coupling 112 and the rotational coupling 120 are revealed.

As can be seen by comparison with FIG. 5, the rotational coupling 112 is oriented at 45 degrees with respect to the support plate 108, and is mounted in opposition to the rotational coupling 120. Similarly, the rotational coupling 120 is oriented at 45 degrees with respect to the support plate 108, and is mounted in opposition to the rotational coupling 112.

Figure 7:
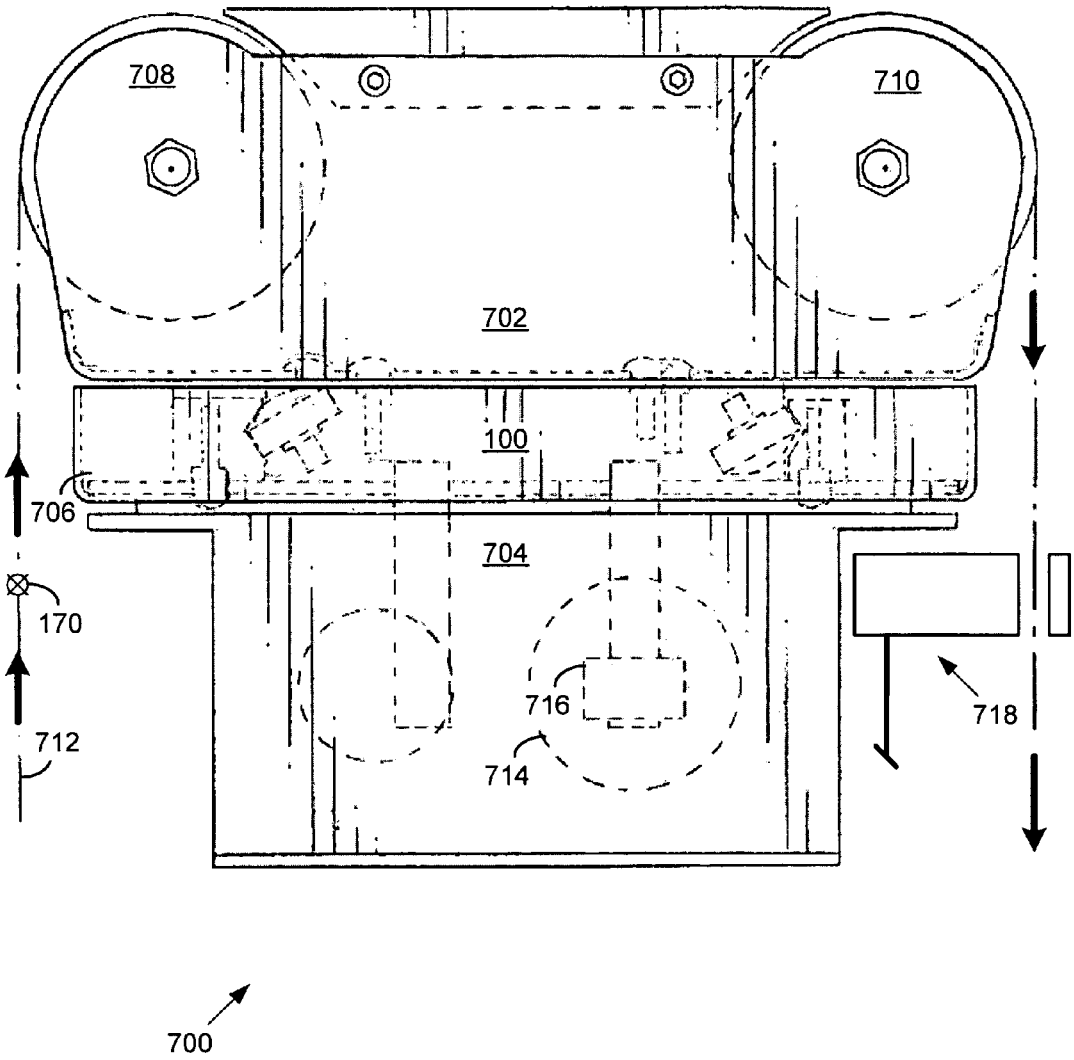
FIG. 7 illustrates a side view of a steering assembly including a steering guide, roller carriage, and drive box.

FIG. 7 illustrates a side view of a steering assembly 700. The steering assembly 700 may include a material guide frame 702, a steering guide 100, and a drive box 704. A protective collar 706 may be provided around the steering guide 100.

The material guide frame 702 may be a roller carriage that includes an entry roller 708 and an exit roller 710. Running material travels through the material guide frame 702. In particular, the material web 712 travels in over the entry roller 708 and out over the exit roller 710.

The guide frame 702 is secured to the steering guide 100. More particularly, the guide frame 702 is secured to the support platform 108. To that end, the guide frame 702 may include positioning posts, shoulder bolts, or other connectors that mate with the positive location holes 132 and 134 in the support platform 108. Bolts may secure the guide frame 702 to the support platform 108 through the threaded connector holes 136 and 138, and through the frame connector holes 140, 142, 144, and 146.

When the guide frame 702 is secured to the support platform 108, the virtual center 170 is aligned with the material web entry point onto the entry roller 708. Consequently, an angular displacement of the support platform 108 will rotate the material guide frame 702 about the virtual center 170 and adjust the lateral position of the material web 712 as it exits over the exit roller 710.

The drive box 704 includes one or more drive mechanisms such as the drive mechanism 714. The drive mechanism 714 may include, for example, a motor 716 (such as a brushless DC motor) that turns a screw attached to the actuator coupling. As the motor 716 drives the screw backward or forward, the drive box 704 imparts an angular displacement to the support platform 108. Other drive mechanisms may also be employed however, including a piston rod, hydraulic cylinder, pneumatic cylinder, or another mechanical or electrical drive mechanism.

An external control system may control the drive mechanism 714. In one embodiment, the external control system may receive input from a material web edge detector assembly 718. Such assemblies are available from Accuweb, Inc. of Madison Wis., for example. Accordingly, in response to the material web position sensed by the edge detector assembly 718, the drive mechanism 714 may steer the material web 712 to keep the material web 712 on any desired path.

The present invention is defined by the following claims, and nothing in this section should be taken as a limitation on those claims. Any one or more of the above described aspects may be used independently or in combination with other aspects. The foregoing detailed description is illustrative rather than limiting, and that it should be understood that it is the following claims, including all equivalents, that are intended to define the spirit and scope of this invention.

The invention claimed is:

1. A steering guide comprising:

a curved inner track;

a curved outer track;

a support platform disposed between the curved inner track and the curved outer track and movably secured to the curved inner track and the curved outer track; and an actuator coupling coupled with the support platform.

2. The steering guide of claim 1, where the curved outer track comprises a guide groove facing the support platform, and further comprising a rotational coupling between the guide groove and the support platform.

3. The steering guide of claim 2, where the rotational coupling comprises a first wheel and a second wheel.

4. The steering guide of claim 3, where the first wheel is oriented in opposition to the second wheel.

5. The steering guide of claim 3, where the guide groove comprises an upper groove track along which the first wheel moves, and a lower groove track along which the second wheel moves.

6. The steering guide of claim 4, where the first wheel is adjacent to the second wheel.

7. The steering guide of claim 2, where the rotational coupling comprises a first wheel pair comprising first and second wheels in opposition and a second wheel pair comprising third and fourth wheels in opposition.

8. The steering guide of claim 7, where the guide groove comprises an upper groove track along which the first and third wheels move, and a lower groove track along which the second and fourth wheels move.

9. The steering guide of claim 1, where the curved inner track comprises a guide groove facing the support platform, and further comprising a rotational coupling between the guide groove and the support platform.

10. The steering guide of claim 9, where the rotational coupling comprises a first wheel and a second wheel.

11. The steering guide of claim 10, where the first wheel is in opposition to the second wheel.

12. The steering guide of claim 11, where the rotational coupling further comprises a third wheel in opposition to the second wheel.

13. The steering guide of claim 11, where the guide groove comprises an upper groove track along which the first wheel moves and a lower groove track along which the second wheel moves.

14. The steering guide of claim 1, further comprising a positive location material guide frame hole in the support platform.

15. The steering guide of claim 14, further comprising a threaded connector hole aligned with the positive location material guide frame hole.

16. A steering guide comprising:

a guide base;

a curved inner track supported by the guide base;

a curved outer track supported by the guide base; and a support platform disposed between the curved inner track and the curved outer track and movably secured to the curved inner track and the curved outer track.

17. The steering guide of claim 16, further comprising an actuator coupling connected to the support platform.

18. The steering guide of claim 17, where the guide base defines a slot and where the actuator coupling extends through the slot.

19. The steering guide of claim 18, where the actuator coupling comprises an actuator stem.

20. The steering guide of claim 16, further comprising a track adjustment for at least one of the curved inner track and the curved outer track.

21. The steering guide of claim 20, where the track adjustment is an inner track adjustment.

22. The steering guide of claim 21, where the inner track adjustment comprises at least one adjustment screw.

23. The steering guide of claim 17, where the guide base defines a first slot and a second slot, and where the actuator coupling comprises a first actuator stem extending through the first slot and a second actuator stem extending through the second slot.

24. The steering guide of claim 16, where the curved inner track and the curved outer track approximately extend through at least 5 degrees of arc.

25. The steering guide of claim 16, where the curved inner track and the curved outer track approximately extend through at least 10 degrees of arc.

26. The steering guide of claim 16, where the guide base further comprises position mg holes for the curved outer track.

27. The steering guide of claim 26, where the curved outer track comprises positioning posts extending into the positioning holes.

28. The steering guide of claim 27, where the curved outer track comprises at least 6000 series machined aluminum.

29. The steering guide of claim 16, further comprising a positive location material guide frame hole in the support platform.

30. The steering guide of claim 16, further comprising a threaded connector hole aligned with the positive location material guide frame hole.

31. A material steering method comprising:

providing a material guide frame;

providing a steering guide comprising:

a curved inner track;

a curved outer track;

a support platform coupled between the curved inner track and the curved outer track and movably secured to the curved inner track and the curved outer track; and an actuator coupling coupled with the support platform;

attaching the material guide frame to the support platform;

running material over the material guide frame; and displacing the support platform.

32. The method of claim 31, where attaching a material guide frame comprises attaching a roller carriage.

33. The method of claim 31, where displacing the support platform comprises imparting an angular displacement to the support platform with the actuator coupling.

34. The method of claim 31, further comprising providing a guide base defining an opening through which the actuator coupling extends.

35. The method of claim 31, where the actuator coupling comprises a first actuator stem and a second actuator stem, and further comprising providing a guide base defining a first opening through which the first actuator stem extends and a second opening through which the second actuator stem extends.

36. The method of claim 35, where the curved outer track defines a center of rotation, and where the first actuator stem is closer to the center of rotation than the second actuator stem.

37. The method of claim 31, further comprising the step of positioning the curved inner track using a track adjustment.

38. The method of claim 31, where attaching the material guide frame comprises positively locating the material guide frame using holes in the support platform.

* * * * *

UNITED STATES PATENT AND TRADEMARK OFFICE

CERTIFICATE OF CORRECTION

PATENT NO. : 7,303,066 B2
APPLICATION NO. : 11/047862
DATED : December 4, 2007
INVENTOR(S) : David O. Rumer It is certified that error appears in the above-identified patent and that said Letters Patent is hereby corrected as shown below:

In the Claims

Column 8, in claim 26, line 2, after "further comprises" delete "position mg" and substitute --positioning-- in its place.

Signed and Sealed this

Sixth Day of May, 2008

JON W. DUDAS
*Director of the United States Patent and Trademark Office*